US006618969B1

(12) United States Patent
Rogers et al.

(10) Patent No.: US 6,618,969 B1
(45) Date of Patent: Sep. 16, 2003

(54) DISPOSABLE EVIDENCE MARKING SYSTEM

(75) Inventors: Richard J. Rogers, Tucson, AZ (US); Bradley F. Rogers, Tucson, AZ (US)

(73) Assignee: Armor Forensics Holdings, Inc., Jackson, FL (US)

( * ) Notice: Subject to any disclaimer, the term of this patent is extended or adjusted under 35 U.S.C. 154(b) by 0 days.

(21) Appl. No.: 10/157,715

(22) Filed: May 28, 2002

(51) Int. Cl.[7] ..... G09F 1/10
(52) U.S. Cl. ..... 40/124.16
(58) Field of Search ..... 40/124.06, 124.09, 40/539, 610; 229/92.8, 155, 150; 116/63 P; 248/174, 459, 460

(56) References Cited

U.S. PATENT DOCUMENTS

| | | | | | |
|---|---|---|---|---|---|
| 4,928,415 | A | * | 5/1990 | Walters | 40/610 |
| 5,787,616 | A | * | 8/1998 | Roger | 40/124.01 |
| 5,915,852 | A | * | 6/1999 | Roger | 40/124.01 |
| 6,149,111 | A | * | 11/2000 | Epstein | 40/126.06 |

* cited by examiner

*Primary Examiner*—Cassandra H. Davis
(74) *Attorney, Agent, or Firm*—Gregory J. Nelson

(57) ABSTRACT

A disposable evidence marker of paper, cardboard or like material. The marker is provided in flat, planar condition and is foldable into an inverted V-shape. An integral tongue and tab may be punched out and interlocked for stability. The investigator may mark the panel surfaces with a conventional marker or pen and discard the markers after use with no clean up necessary.

8 Claims, 1 Drawing Sheet

DISPOSABLE EVIDENCE MARKING SYSTEM

FIELD OF THE INVENTION

The present invention relates to a marking device and more particularly to a compact disposable marker for use by law enforcement investigators and forensic personnel for marking and identifying items of evidence at a crime.

BACKGROUND OF THE INVENTION

The proper handling and marking of evidence at a crime scene is essential to police and law enforcement to assure a fair trial, protect the chain of custody and provide a basis for admissibility of evidence. Conventional practice is for law enforcement investigators and forensic technicians to separately mark and identify each object or item of evidence at a crime scene. In the past, investigating personnel have used index cards or adhesive-backed notes inscribed with an identification number. These notes or cards are then placed adjacent a particular evidence item and a photographer will take photographs so that the photographs may be subsequently used during investigation or at a trial. Use of this type of marking system has obvious disadvantages. Conventional index cards and adhesive-backed notes provide limited space for receiving information. Further, such items are generally placed flat on a surface and therefore are visible only in photographs taken directly above or in line with the evidence item.

Because of these many disadvantages, improved evidence marker systems have been developed. For example, U.S. Pat. Nos. 5,787,616 and 5,915,852 show improved evidence markers which may be placed adjacent an evidence item at a crime scene having upstanding panels connected to form a free-standing unit. A base extends from the lower edge of the upstanding panels and is imprinted with reference indicia such as suitable reference scales and a photographic target to assist the photographer in taking clear, sharp photographs. The surface of the panels carry indicia such as sequential numbers or letters for identification. The markers may be placed on a horizontal surface or suspended using a fastener from a vertical surface, such as a wall.

The markers are provided to law enforcement personnel in kits containing multiple sequentially imprinted markers which are nestable and stackable. Accordingly, the makers of the type shown in the two patents disclosed above have become widely accepted and used by law enforcement personnel including federal, state and local agencies and are available from EVI-PAQ of Tucson, Ariz.

Notwithstanding the above, there exists a need in some instances for a crime scene and forensic ID markers which are inexpensive and disposable and which may be used when markers of the type shown in the '852 patent and '616 patent are not available or when an inexpensive, easy to use maker is required.

Brief Summary of the Invention

Accordingly, the present invention provides a evidence marker which is provided to the user in a planar form. The marker is fabricated from an inexpensive material such as cardboard, paperboard or fiberboard having a surface to which can be written appropriate indicia such as notes and reference markings. The marker has opposite sides and ends and a fold line at an intermediate location so that it may be erected by folding the marker into a generally inverted "V"-shape having two panel surfaces. Fold lines may also be provided parallel to the opposite ends so that when erected, the bottom end portions may be folded outward for additional stability.

A unique punch-out assembly includes a tongue having opposite sides and end and which is hinged to one of the panels. A tab is formed in the other section adjacent the tongue having a hinged section with the center of the hinge line slit to form a slot. When the marker is erected into an inverted V- shape, the tongue may be folded downwardly and the end inserted into the slot in the tab to lock the structure in this position. A quick, easy-to-use marker is formed which will remain erect until the investigation is completed. After, use the evidence markers may be retained or can simply be discarded with no clean-up necessary. Pre-printed marking may also be provided such as check boxes so the investigator may indicate the evidence has been photographed and logged by checking the appropriate box.

BRIEF DESCRIPTION OF THE DRAWINGS

The above and other objects and advantages of the present invention will be more fully appreciated from the following description, claims and drawings in which:

DETAILED DESCRIPTION OF THE DRAWINGS

Figure 4:
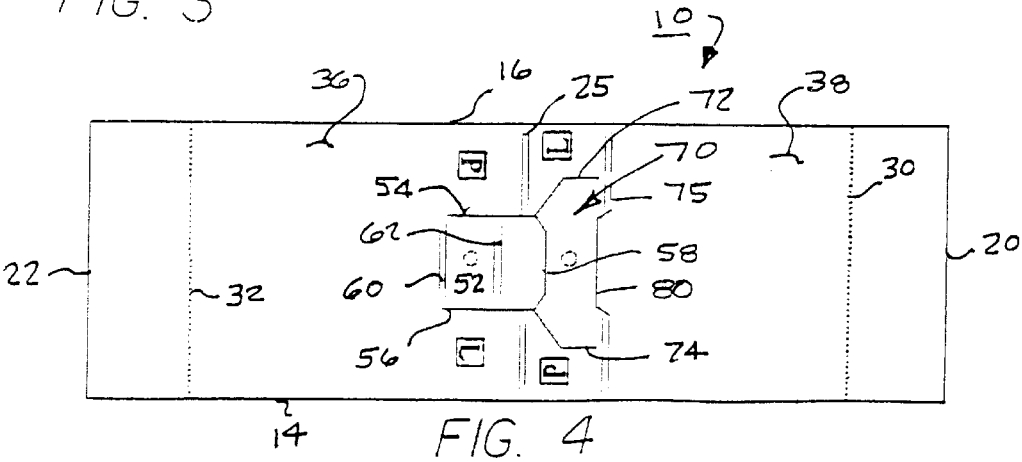
FIG. 4 is a plan view of the evidence marker in a flat, planar condition as provided to the user.

Turning now to the drawings, a preferred embodiment of the evidence marker of the present invention is shown and is generally designated by the numeral 10. The marker is provided to the user in a generally planar form as shown in FIG. 4. The evidence marker is fabricated from sheet stock and preferably an inexpensive material such as cardboard, heavy paper or fiberboard which has sufficient rigidity so as to be free-standing when erected. The marker 10, is generally rectangular having opposite sides 14 and 16 and opposite ends 20 and 22. The marker may be of various sizes but preferably is about 3 to 6 inches wide and approximately 10 to 16 inches long in order to provide sufficient visibility and also adequate surface areas for application of writing such as notes and numbers.

A fold line 25 extends transversely between sides 14 and 16 at an intermediate location. Similarly, fold lines 30 and 32 extend parallel to the fold line 25. The fold lines 30 and 32 are spaced inwardly from the edges 20 and 22. The fold lines may be markings but are preferably creases or perforated to accommodate easy folding.

Figure 1:
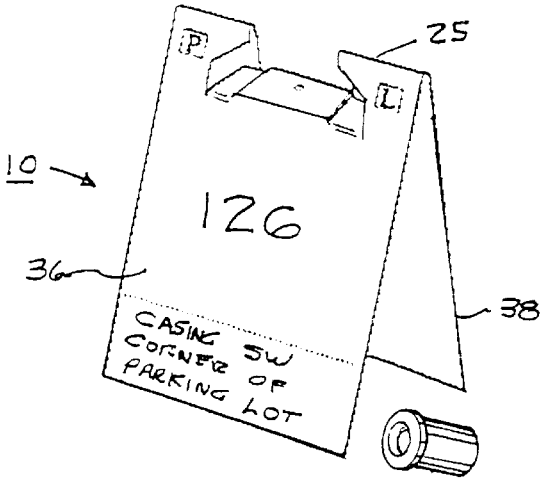
FIG. 1 is perspective view of the evidence marker of the present invention shown in an erected, in use position.
Figure 2:
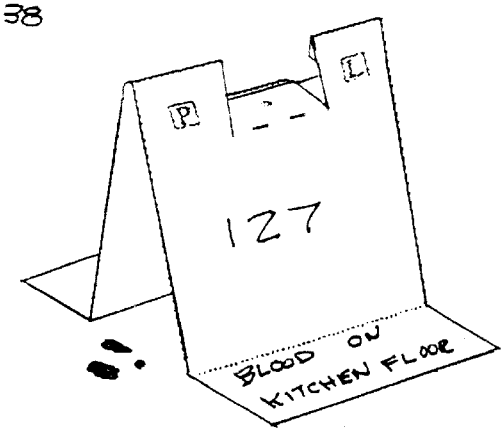
FIG. 2 is a perspective view of the evidence marker shown in an alternate position of use.

When placed in use, the planar marker, as shown in FIG. 4, is erected by folding into a generally inverted V-shape configuration along the intermediate fold line 25. For increased stability, the opposite lower ends of the panel may be folded outwardly along fold lines 30, 32 to provide ground-engaging feet as seen in FIG. 2. When so erected, it will be seen that the evidence marker 36 and 38 which are available to the user so the user may place notes and numbers and other information on these surfaces. In FIGS. 1 and 2, the markers have been provided with information concerning the identification, number and location of evidence items.

Figure 3:
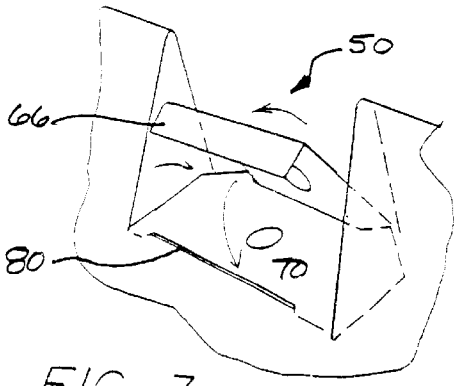
FIG. 3 illustrates the steps in erecting the evidence marker to a position of use.

Since evidence markers are often used in adverse conditions, a punch-out locking assembly 50 is provided to maintain the evidence marker in the inverted V-shape condition when erected. The punch-out locking assembly is best seen in FIGS. 3 and 4. A tongue 52 is formed by two longitudinal score lines or slits 54, 56 extending in panel 36 from approximately the fold line 25. Another slit 58, generally parallel to the apex fold line, extends between the two longitudinal slits to form the tongue. The corners of the tongue may be slightly beveled at the intersection of the slits. A fold line 62 extends between the both ends of the slits and a second fold line 62 extends laterally at an intermediate location so that when the tongue is separated from panel 36 by folding it inwardly, the distal end 66 can be bent downward forming a generally L-shaped structure, as seen in FIG. 3.

A tab 70 is formed in the panel 38 adjacent the tongue. Tab 70 has opposite, spaced-apart slits 72 and 74 which extend from a transverse fold line 75 toward the apex. The slits then converge inwardly to intercept the slits 58. The upper edge of the tab conforms to the shape of the end of the tongue as a single slit or cut is made between these two components. Another cut 80 extends along the tab fold line 75 at an intermediate location having a transverse dimension slightly greater than the transverse dimension of the tongue.

The versatile features of the present invention will be better understood and appreciated from the following description of use. A plurality of evidence markers are provided to the user, such as a law enforcement agency, in a flattened or planar condition shown in FIG. 4. The markers are cardboard, paperboard, fiberboard or other inexpensive material and generally would be provided in a bundle or stack of multiple markers. At a crime scene, the marker can be erected and placed near evidence items such as a shell casing as shown. The investigator at the crime scene will select one of the makers and fold it along the fold line to form a generally inverted V. The tongue 52 and tab 70 are folded inwardly and downwardly to a generally horizontal position with the tongue overlying the tab. This is done by applying a manual force with a thumb or finger. The distal portion 66 of the tongue is bent downwardly along the fold line 62 on the tongue so that it extends generally vertically and then may be inserted into the slit 80 at the intermediate location along the tab hinge line. In this position, the evidence marker is a rigid, free-standing structure due to the punch-out locking assembly and will resist unintended spreading of the sidewalls. The tab and tongue both extend horizontally in engaged overlapping relationship between the panels to provide support. Collapse of the structure is resisted by the engagement of the end of the tongue in the cutout at the intermediate hinge section.

If additional stability is required, the lower ends of panels 36, 38 can be bent outwardly at fold lines 20, 30 to provide additional ground-engaging surfaces. The surface of panels 36 and 38 are receptive to application of notes or markings using a pen or pencil. The preferably the surface is light colored to allow the investigative personnel to write notes and evidence identification numbers on the surfaces using conventional markers or pens.

As seen in FIGS. 1 and 2, the surface of the panels may be preprinted with certain information which can be checked or circled by the investigator. For the convenience of the investigator, typical markings would be check boxes with the letters P and L to indicate that the evidence item has been photographed and logged.

Once the investigation is complete, the marker can be disassembled to a flattened condition and discarded with no cleanup necessary. This is particularly useful in crime scenes which may have contamination such as blood or chemicals, as well as a crime scene with a high number of articles of evidence.

It will be obvious to those skilled in the art to make various modifications to the structure, arrangement, proportion, elements materials and components used in the practice of the present invention. To the extent that these various modifications do not depart from the spirit and scope of the appended claims, there are intended to be encompassed therein.

We claim:

1. A marker for placement adjacent an item for purposes of identification, said marker comprising:

(a) a generally planar section of material having opposite sides and ends, said section defining a fold line extending between the sides at an intermediate location so the section can be formed into a generally free-standing inverted V-shaped structure having outwardly facing panels having opposite sides, a common top edge and bottom edges.

(b) interlocking members including a tab on one panel and a tongue on the other panel, said tongue and tab being defined along separable lines, whereby the tab and tongue may each be partially separated from its respective associated panel; and (c) said tongue and tab being located adjacent the common edge intermediate the sides and being foldable to extend in generally overlying interlocking relationship between the panels to maintain the panels in a free standing generally inverted V-shaped structure independent of any additional structure.

2. The marker of claim 1 wherein said tongue and tab are defined by score lines.

3. The marker of claim 1 wherein the marker is fabricated from the group of materials consisting of paper, cardboard, fiberboard and corrugated cardboard.

4. The marker of claim 1 wherein at least one of said panels is provided with pre-printed indicia.

5. The marker of claim 1 wherein the marker is an evidence marker for use at a crime investigation site.

6. A marker for placement adjacent an evidence item at an investigation site for purposes of identification, said marker comprising:

(a) a generally rectangular section of a rigid, foldable material having opposite sides and opposite ends, said section defining a fold line extending between the sides at an intermediate location so the section may be formed into a generally free standing inverted V-shaped structure having outwardly facing panels having opposite sides a common top edge and bottom edges;

(b) interlocking members formed in said section including a tab on one panel and a tongue on the other, said tongue having a distal end, said tongue and tab being defined along separable lines whereby the tab and tongue may each be partially separated from its associated panel and folded along a transverse fold line;

(c) said tab fold line defining a slit extending partway therealong; and (d) said tongue and tab being foldable to extending in generally overlying relationship between the panels to maintain the panels in a free standing generally inverted V-shaped structure with the distal end of said tongue engageable in said slit.

7. A marker for placement adjacent an item for purposes of identification, said marker comprising:

(a) a generally planar section of material having opposite sides and ends, said section defining a fold line extending between the sides at an intermediate location so the section can be formed into a generally free-standing inverted V-shaped structure having outwardly facing panels having opposite sides, a common top edge and bottom edges;

(b) interlocking members including a tab on one panel and a tongue on the other panel, said tongue and tab being defined along separable lines, whereby the tab and tongue may each be partially separated from its respective panel, said tab being foldable along a transverse fold line, said fold line defining a slit extending partway along said fold line, said tongue being foldable along a transverse fold line forming a distal end engagable in said slit in said tongue; and (c) said tongue and tab being foldable to extend in generally overlying relationship between the panels to maintain the panels in a free standing generally inverted V-shaped structure.

8. A marker for placement adjacent an item for purposes of identification, said marker comprising:

(a) a generally planar section of material having opposite sides and ends, said section defining a fold line extending between the sides at an intermediate location so the section can be formed into a generally free-standing inverted V-shaped structure having outwardly facing panels having opposite sides, a common top edge and bottom edges, said panels each defining fold lines extending adjacent and parallel to their bottom edges whereby the lower ends of the panels may be folded to provide stabilizing feet;

(b) interlocking members including a tab on one panel and a tongue on the other panel, said tongue and tab being defined along separable lines, whereby the tab and tongue may each be partially separated from its respective panel; and (c) said tongue and tab being foldable to extend in generally overlying relationship between the panels to maintain the panels in a free standing generally inverted V-shaped structure.

* * * * *